US011274881B2

(12) United States Patent
Zhdanok

(10) Patent No.: US 11,274,881 B2
(45) Date of Patent: Mar. 15, 2022

(54) PYROLYSIS FURNACE WITH EXTERNAL HEATING FOR PROCESSING SOLID CARBONCARBON-CONTAINING MATERIALS (VARIANTS)

(71) Applicant: THERMODEG S.R.O., Dunajska Streda (SK)

(72) Inventor: Vitali Aleksandrovich Zhdanok, Minsk (BY)

(73) Assignee: ThermoDeg s.r.o., Dunajska Streda (SK)

( * ) Notice: Subject to any disclaimer, the term of this patent is extended or adjusted under 35 U.S.C. 154(b) by 268 days.

(21) Appl. No.: 16/096,547

(22) PCT Filed: Jan. 25, 2017

(86) PCT No.: PCT/EA2017/000001
§ 371 (c)(1),
(2) Date: Oct. 25, 2018

(87) PCT Pub. No.: WO2017/186253
PCT Pub. Date: Nov. 2, 2017

(65) Prior Publication Data

US 2019/0137181 A1 May 9, 2019

(30) Foreign Application Priority Data

Apr. 26, 2016 (EA) ..... 201600392

(51) Int. Cl.
*F27B 7/08* (2006.01)
*F27B 7/33* (2006.01)
(Continued)

(52) U.S. Cl.
CPC ..... *F27B 7/08* (2013.01); *C10B 47/30* (2013.01); *F27B 7/224* (2013.01); *F27B 7/30* (2013.01);
(Continued)

(58) Field of Classification Search
CPC .... F27B 7/224; F27B 7/28; F27B 7/30; F27B 7/08; F27B 7/33; F27B 7/42; F27M 2001/04; F27M 2003/14; C10B 47/30
See application file for complete search history.

(56) References Cited

U.S. PATENT DOCUMENTS 8,366,882 B2 * 2/2013 Rinker ..... C10G 1/00 201/8
8,470,134 B2 * 6/2013 Rinker ..... C10L 9/08 201/29

(Continued)

*Primary Examiner* — Steven S Anderson, II
(74) *Attorney, Agent, or Firm* — Jason D. Voight

(57) ABSTRACT

A pyrolysis furnace having a heating chamber which surrounds a cylindrical pyrolysis chamber. The heating chamber is assembled from an upper part and a lower part, which can be joined. Each part of the heating chamber is provided with two rows of heating elements, which are arranged along the length of the housing of the heating chamber symmetrically relative to a vertical plane passing through the axis of the pyrolysis chamber. The heating elements are in the form of units, containing at least one flameless gas burner. The heating elements in the upper part of the heating chamber are arranged in a checkerboard fashion relative to the heating elements in the lower part. The furnace relates to power generation and the environment and is intended for the thermal processing of solid and free-flowing materials, particularly in processes for the pyrolysis of solid carbon-containing materials, including municipal and domestic waste.

14 Claims, 2 Drawing Sheets

(51) Int. Cl.

| | |
|---|---|
| ***F27B 7/22*** | (2006.01) |
| ***F27B 7/30*** | (2006.01) |
| ***F27B 7/42*** | (2006.01) |
| ***C10B 47/30*** | (2006.01) |
| *F27B 7/28* | (2006.01) |

(52) U.S. Cl.
CPC ..... *F27B 7/33* (2013.01); *F27B 7/42* (2013.01); *F27B 7/28* (2013.01); *F27M 2001/04* (2013.01); *F27M 2003/14* (2013.01)

(56) References Cited

U.S. PATENT DOCUMENTS

| | | | | |
|---|---|---|---|---|
| 2011/0136971 | A1* | 6/2011 | Tucker | B82Y 40/00 524/587 |
| 2012/0161451 | A1* | 6/2012 | Struble | C01B 3/32 290/1 R |
| 2013/0004409 | A1* | 1/2013 | Tucker | C10B 53/04 423/445 R |

* cited by examiner

PYROLYSIS FURNACE WITH EXTERNAL HEATING FOR PROCESSING SOLID CARBONCARBON-CONTAINING MATERIALS (VARIANTS)

This is the national stage of International Application PCT/EA2017/000001, filed Jan. 25, 2017.

The invention relates to power generation and the environment and is intended for the thermal processing of solid and free-flowing materials, in particular in processes for the pyrolysis of solid carbon-containing materials, including municipal and domestic waste. The apparatus can also be used for activation of carbon materials, calcination, drying and in other operational procedures associated with heating in a controlled environment.

A method of thermal decomposition of fuels [1] is known in the prior art, in which furnace walls are made of flameless gas burners. Fuel enters the upper part of the furnace and, while descending, is directly exposed to infrared rays, which enables intensification of the process. The disadvantage of the method is that radiant heat cannot be transferred to the entire depth of the product layer.

Another prior art discloses an assembly for thermal decomposition of carbon-containing materials [2]. The assembly comprises a rotating drum with a retort installed axisymmetrically therein; pyrolysis gases are burned in an annular space between the retort and walls of the drum, whereby external radiating/conductive heating of the retort is provided.

The disadvantage of the known invention is the uneven heating of the retort and the drum.

The prior art most closely related to the present invention by its technical nature is an externally heated pyrolysis furnace for carbonization and activation of carbon material [3], comprising a hollow rotating body having an inlet and a discharging side and mounted with a downward tilt towards the discharging side; a housing surrounding the body and defining, together with the body, a plurality of heating chambers; gas burners in each heating chamber, wherein the temperature of each chamber is independently adjustable; annular partitions spaced apart along the rotating body to control the movement of material through the body; means for supplying carbonaceous material to the charging end; a feed pipe for supplying substantially oxygen-free vapour or carbon dioxide into the rotating body.

The pyrolysis furnace is insufficiently reliable and safe due to the use of flame gas burners and the potential for overheating the rotating body at elevated temperature of the gas burner torch, as well as the insufficient intensity of heat exchange and a certain complexity of maintenance.

The object of the present invention is to provide an externally heated drum-type pyrolysis furnace for processing solid carbon-containing materials, which exhibits enhanced reliability, safety, heat transfer efficiency and improved maintainability.

The object is attained in an externally heated pyrolysis furnace for processing solid carbon-containing materials, comprising a base 1; a pyrolysis chamber 2 disposed on said base and being in the shape of a cylinder with end covers 3, which are connected to a charging tube 4 and a discharging tube 5; a heating chamber 6, which surrounds the pyrolysis chamber 2 and includes a thermally-insulated housing 7 having disposed therein heating elements 8 and 9, partitions 10, 11, 12 and a branch pipe 13 for the removal of flue gases, which is situated in the upper part of the heating chamber 6; a feed pipe 14 for supplying an atmosphere of water vapour or carbon dioxide to the pyrolysis chamber 2; and a pipe 15 for the removal of gaseous products from the pyrolysis chamber 2. The heating chamber 6 is assembled from an upper part and a lower part, which can be joined; each of the parts of the heating chamber 6 is provided with two rows of heating elements 8, 9, which are arranged along the length of the housing 7 of the heating chamber 6 symmetrically relative to a vertical plane which passes through the axis of the pyrolysis chamber 2. The heating elements 8, 9 are in the form of units containing at least one flameless gas burner, wherein the heating elements 8 in the upper part of the heating chamber 6 are arranged in a checkerboard fashion relative to the heating elements 9 in the lower part of the heating chamber 6. The partitions 10, 11, 12 comprise: two end annular partitions 10 disposed on the edges of the heating chamber 6; a partition 11 disposed along the lower part of the heating chamber 6; annular partitions 12 defining pairwise separate gas channels 16 for each heating element 8, 9 for exhaust gas streams leaving them. The branch pipe 13 for the removal of flue gases is provided with a heat exchanger 17, to which the feed pipe 14 is connected for supplying an atmosphere of water vapour or carbon dioxide to the pyrolysis chamber 2.

Alternatively to the first embodiment, in the second embodiment the partitions comprise: two end annular partitions 10 disposed on the edges of the heating chamber 6; a partition disposed along the lower part of the heating chamber 6; screening partitions 18 in the upper part of the heating chamber 6 for directing the exhaust gas stream from the heating element 8 upward the heating chamber 6 and restricting the influence of the heating elements 9 of the lower part of the heating chamber 6 on them; and screening partitions 19 in the lower part of the heating chamber 6 for restricting lateral movement of the exhaust gas stream from the heating elements 9 and the mutual influence thereof.

Furthermore, in the preferred second embodiment the screening partitions 18 consist of two side parts made in the form of a ring segment and disposed on both sides of each heating element 8, the side parts being coupled by a splitter directed toward the heating elements 9. The screening partitions 19 also made in the form of a ring segment.

In both embodiments the pyrolysis chamber 2 can be a drum-type or screw-type chamber.

In both embodiments the heat exchanger 17 is preferably coil-shaped, and the pyrolysis chamber 2 is provided with pressure and temperature sensors.

Use of the present invention offers the following technical advantages.

1. The use of flameless gas burners as heating elements eliminates potential overheating of the pyrolysis chamber walls when gas is burned in them owing to the absence of open flame and exposure of the walls to high temperature effects, whereby reliability and safety are enhanced.

2. The arrangement of heating elements in a checkerboard fashion provides even distribution of radiation fluxes and exhaust gas streams from the heating elements over the outer surface of the pyrolysis chamber, and the present options of arrangement of partitions in the heating chamber housing can organize movement of flue gases from operating heating elements such that they would not influence each other and impair their performance, and the high-temperature combustion products (flue gases) would not go beyond the heating chamber through its end surfaces, while evenly flowing around the pyrolysis chamber surface with maximum contact area. Such an optimal combination of radiant heating (by radiation) and convective heating (by contact with flue gases) of the pyrolysis chamber in the present heating chamber design significantly intensifies the heat exchange between the heating chamber and the pyrolysis chamber compared to heating only by flue gases when flame gas burners are used.

3. The assembly of the heating chamber from upper and lower parts, which can be joined, enhances maintainability owing to the fact that maintenance and replacement of the pyrolysis chamber can be organized with the upper part of the heating chamber removed.

The invention is illustrated in the drawings.

Figure 1:
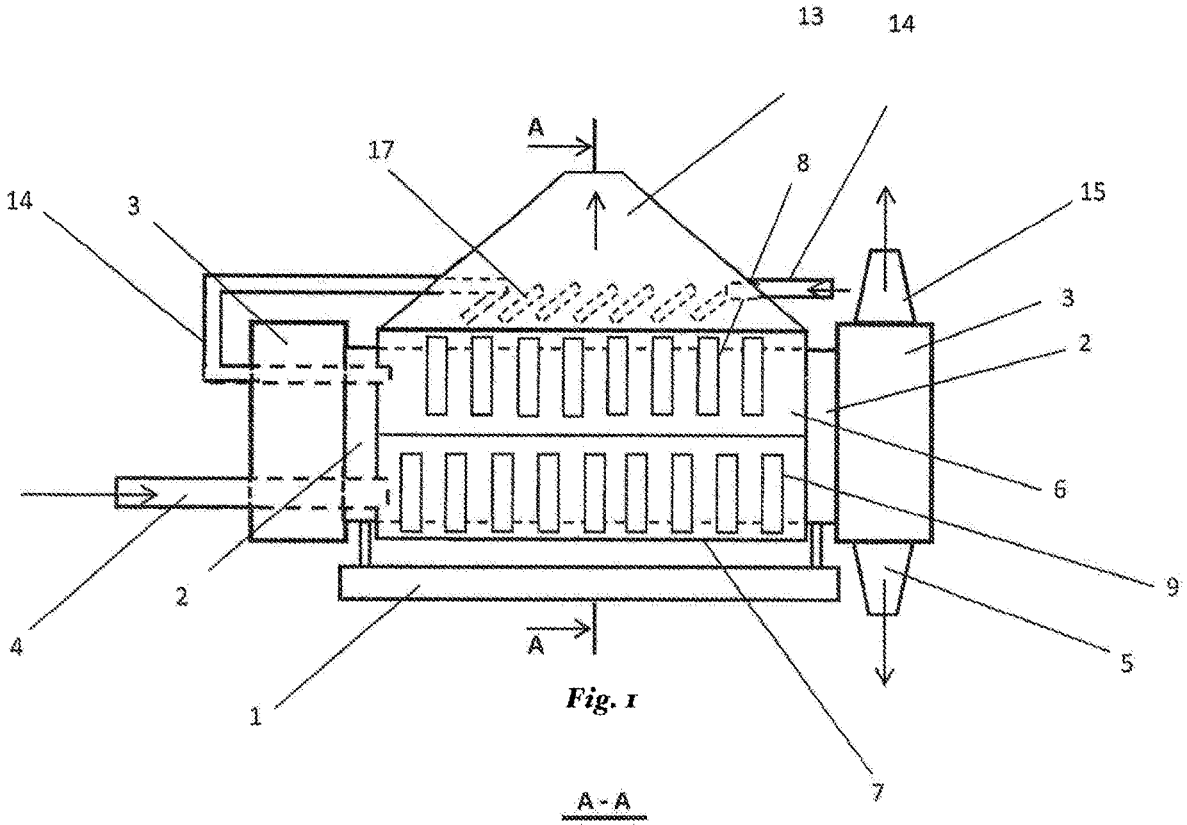
FIG. 1 is a general view of an externally heated pyrolysis furnace.

An externally heated pyrolysis furnace for processing solid carbon-containing materials (FIG. 1, 2) comprises a base 1, in particular, a support frame, on which a pyrolysis chamber 2 is disposed on two support racks, the pyrolysis chamber having the shape of a cylinder with end covers 3 connected with a charging tube 4 and a discharging tube 5; a heating chamber 6 surrounding the pyrolysis chamber 2 and including a thermally-insulated housing 7 with heating elements 8, 9 disposed thereon. A branch pipe 13 for the removal of flue gases is arranged in the upper part of the heating chamber 6 along its entire length and is provided with a heat exchanger 17, preferably coil-shaped, to which a feed pipe 14 is connected for supplying the atmosphere of water vapour or carbon dioxide into the pyrolysis chamber 2. The pyrolysis furnace further comprises a pipe 15 for the removal of gaseous products from the pyrolysis chamber 2. The heating chamber 6 is assembled from an upper part and a lower part, which can be joined; the upper part of the heating chamber 6 is provided with two rows of heating elements 8, and the lower part of the heating chamber 6 is provided with two rows of heating elements 9. The heating elements 8, 9 are arranged along the length of the housing 7 of the heating chamber 6 symmetrically relative to a vertical plane which passes through the axis of the pyrolysis chamber 2. The heating elements 8, 9 are made in the form of units, each unit may consist of one or more burners to reach a specified power of the unit and/or to provide a radiating surface with a specified shape and area. The heating elements 8 in the upper part of the heating chamber 6 are arranged in a checkerboard fashion relative to the heating elements 9 in the lower part of the heating chamber 6.

Figure 2:
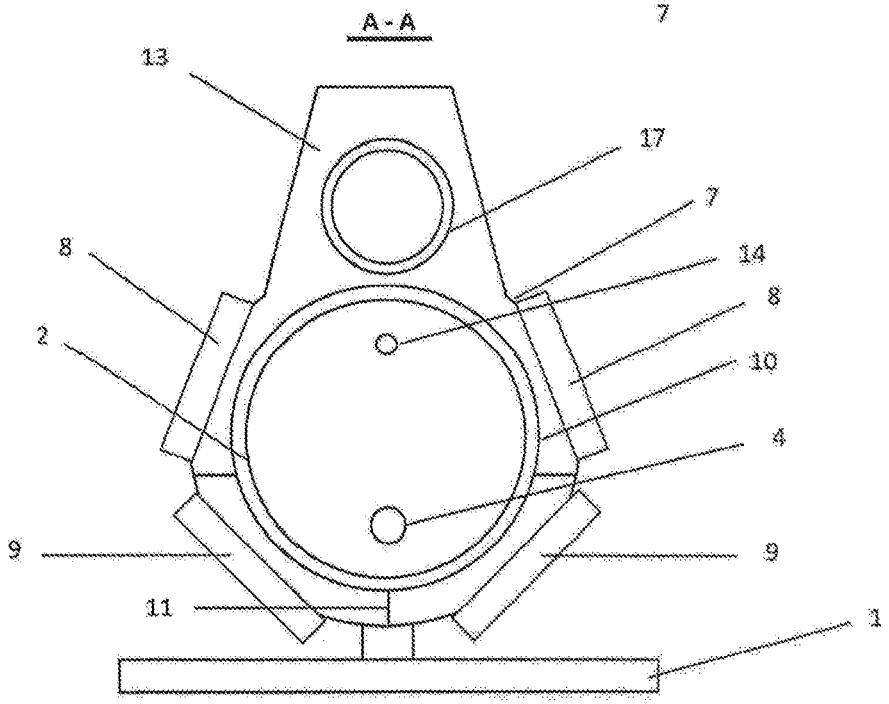
FIG. 2 is a cross sectional view of an externally heated pyrolysis furnace (section A-A, right side view).
Figure 3:
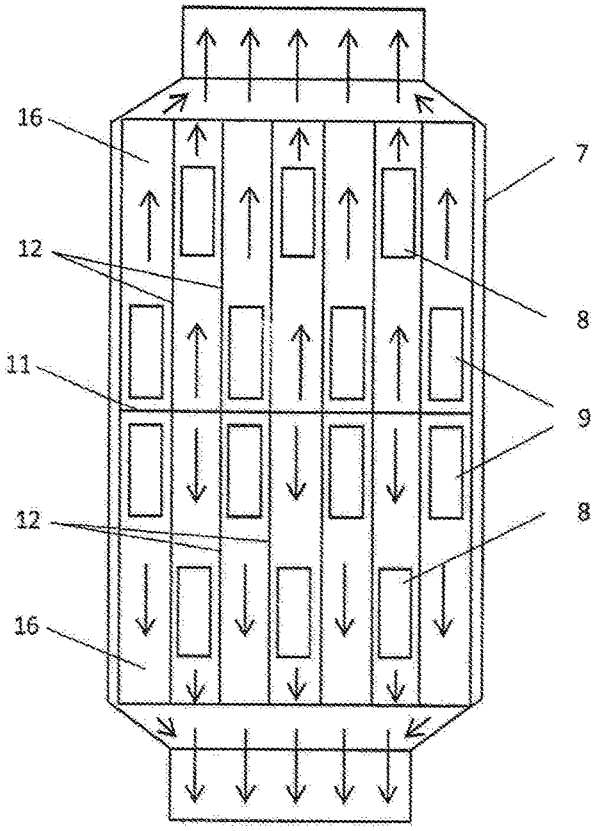
FIG. 3 is a developed view of a fragment of the heating chamber, first embodiment.

The invention is presented in two embodiments. According to a first embodiment, the partitions comprise: two end annular partitions 10 (FIG. 2) disposed on the edges of the heating chamber 6 and restricting exhaust of flue gases from the heating elements 8, 9 outward from the heating chamber 6 through its end surfaces; a partition 11 (FIGS. 2, 3, 4) disposed along the lower side of the heating chamber 6 and dividing the inner space of the heating chamber 6 into two parts to form thereby two symmetrical ascending exhaust gas streams from the heating elements 8, 9, which flow around the pyrolysis chamber 2 from opposite sides; annular partitions 12 (FIG. 3) defining pairwise separate gas channels 16 for each heating element 8, 9 for flue gases exhaust from them.

Figure 4:
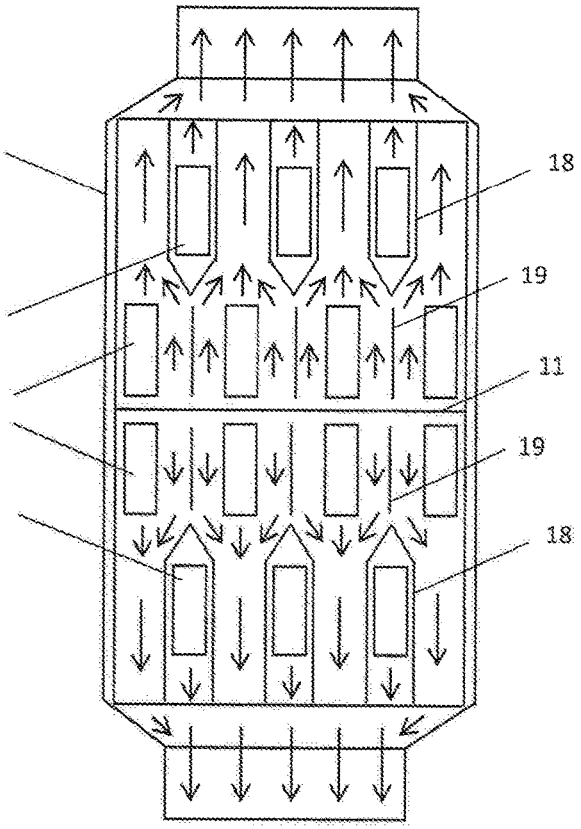
FIG. 4 is a developed view of a fragment of the heating chamber, second embodiment.

The second embodiment also comprises two end annular partitions 10 (FIG. 2) disposed at ends of the heating chamber 6; a partition 11 (FIGS. 2, 3, 4) disposed along the lower part of the heating chamber 6 and dividing the internal space of the heating chamber 6 into two parts to form thereby two symmetrical ascending exhaust gas streams from the heating elements 8, 9, which flow around the pyrolysis chamber 2 from opposite sides. In contract to the first embodiment, the second embodiment comprises screening partitions 18, 19 (FIG. 4). The screening partitions 18 in the upper part of the heating chamber 6, which direct the exhaust gas stream from the heating elements 8 upward the heating chamber 6 and restrict the influence on them of the heating elements 9 of the lower part of the heating chamber 6, in the preferred embodiment are made from two side parts in the form of a ring segment, which are disposed on both sides of each heating element 8 and are connected by a splitter directed towards the heating elements 9. The screening partitions 19 in the lower part of the heating chamber 6, which restrict lateral movement of flue gases exhaust from the heating elements 9 and their mutual influence on each other, are also made in the form of a ring segment in this example.

In both embodiments the pyrolysis chamber 2 can be a drum-type or screw-type chamber.

If a drum-type pyrolysis chamber 2 is used, the end covers 3 are provided with end seals (not shown) to ensure immobility of the covers 3 when the drum-type pyrolysis chamber 2 is rotating.

The pyrolysis chamber 2 can be provided with pressure and temperature sensors (not shown).

The externally heated pyrolysis furnace according to the invention can use an automation system.

The externally heated pyrolysis furnace according to the first embodiment operates as follows.

Carbon dioxide is fed, via the feed pipe 14, into the pyrolysis chamber 2, and the pyrolysis chamber 2 is purged to displace residual air. Combustion gas is then supplied to the heating elements 9 and they are ignited. The pyrolysis chamber 2 is exposed to thermal radiation from the heating elements 9, and owing to convection the heat of flue gases resulting from operation of the heating elements, which, being pushed away from the partition 11 dividing the internal space of the heating chamber 6 into two symmetrical parts, move upward through the gas channels 16 defined by the annular partitions 12 and outward from the heating chamber 6 through the branch pipe 13, while flowing around the outer surface of the pyrolysis chamber 2 from both sides relative to the vertical plane in which the partition 11 is disposed. Combustion gas is fed to the heating elements 8 and they are ignited. The intensity of heating the pyrolysis chamber 2 increases due to the additional effect of thermal radiation from the heating elements 8 and also due to convective heat transfer from the flue gases resulting from operation of the heating elements; these flue gases are carried away by the exhaust gas streams from the heating elements 9, move upward and outward from the heating chamber 6 via the branch pipe 13; therewith, the uniformity of heating the surface of the pyrolysis chamber 2 is improved due to the checkerboard arrangement of the heating elements 8 and 9. Flue gases resulting from the operation of the heating elements 8 and 9 leave the heating chamber 6 through the branch pipe 13, while flowing around the heat exchanger 17 and heating the same by convention. Water vapour or carbon dioxide, heated in the heat exchanger 17, is supplied through the feed pipe 14 into the pyrolysis chamber 2 to provide protective atmosphere therein. Preground solid carbon-containing material is supplied via the charging tube 4 into the heated pyrolysis chamber 2, where it contacts the inner surface of the pyrolysis chamber 2, having high temperature owing to the heat transfer from the heating elements 8 and 9 and flue gases exhaust from them, and the pyrolysis process takes place. Pyrolysis gas entering the pipe is withdrawn outward from the pyrolysis chamber 2; solid residue resulting from the decomposition of the solid carbon-containing material after release of pyrolysis gas is also withdrawn outward from the pyrolysis chamber 2 through the discharging tube 5.

Operation of the externally heated pyrolysis furnace according to the second embodiment is different from that according to the first embodiment in that the flue gases resulting from operation of the heating elements 9, pushed away from the partition 11, move upward the heating chamber 6, while the screening partitions 19 restrict lateral movement of the exhaust gas streams from adjacent heating elements 9 and mutual influence of the heating elements 9. Then the exhaust gas flows around the outer surface of the pyrolysis chamber 2 from both sides relative to the vertical plane, in which the partition 11 is disposed, flows around outer sides of the screening partitions 18 and leave the heating clamber 6 via the branch pipe 13, while flowing around the heat exchanger 17 and heating the same by convention.

Flue gases resulting from operation of the heating elements 8, pushed away from the screening partitions 18, move upward the heating chamber 6, mix with the exhaust gas stream from the heating elements 9 and leave the heating chamber 6 via the branch pipe 13, while flowing around the heat exchanger 17 and also heating the same by convention. Therewith, the partitions 18 cut the flue gases resulting from operation of the heating elements 9 and rising up to the output branch pipe 13 and do not adversely affect ignition and performance of the heating elements 9.

REFERENCES CITED

1. Inv. Cert. SU 167812, C10B, publ. May 11, 1965
2. Inv. Cert. SU 397729, F27B 7/04, publ. 1970.
3. Patent RU 2478573, CO1B31/08, C10B47/30, C10B53/07, F27B 7/16, publ. Oct. 4, 2013

The invention claimed is:

1. An externally heated pyrolysis furnace for processing solid carbon-containing materials, comprising a base;

a pyrolysis chamber disposed on said base and being in the shape of a cylinder with end covers, which are connected to a charging tube and a discharging tube;

a heating chamber, which surrounds the pyrolysis chamber and includes a thermally-insulated housing, said heating chamber having disposed therein two rows of upper heating elements in an upper part of the heating chamber and two rows of lower heating elements in a lower part of the heating chamber, two end annular partitions disposed on edges of the heating chamber, a partition disposed along the lower part of the heating chamber, annular partitions defining pairwise separate gas channels for each of the upper heating elements and each of the lower heating elements for exhaust gas streams leaving them, and a branch pipe for the removal of flue gases, which is situated in the upper part of the heating chamber;

a feed pipe for supplying an atmosphere of water vapor or carbon dioxide gas to the pyrolysis chamber; and a pipe for the removal of gaseous products from the pyrolysis chamber, wherein the two rows of upper heating elements and the two rows of lower heating elements are arranged along the length of the housing of the heating chamber symmetrically relative to a vertical plane that is an extension of an axis of the pyrolysis chamber;

the upper heating elements and the lower heating elements are in the form of units containing at least one flameless gas burner;

the upper heating elements are arranged in a checkerboard fashion relative to the lower heating elements; and the branch pipe for the removal of flue gases is provided with a heat exchanger, to which the feed pipe is connected for supplying an atmosphere of water vapor or carbon dioxide to the pyrolysis chamber.

2. The furnace according to claim 1, characterized in that the pyrolysis chamber is a rotary drum reactor.

3. The furnace according to claim 1, characterized in that pyrolysis chamber is a screw reactor.

4. The furnace according to 1, characterized in that heat exchanger is coil-shaped.

5. The furnace according to claim 1, characterized in that the pyrolysis chamber is provided with pressure and temperature sensors.

6. The furnace according to claim 1 wherein the upper part of the heating chamber abuts and is connected to the lower part of the heating chamber.

7. An externally heated pyrolysis furnace for processing solid carbon-containing materials, comprising a base;

a pyrolysis chamber disposed on said base and being in the shape of a cylinder with end covers, which are connected to a charging tube and a discharging tube;

a heating chamber, which surrounds the pyrolysis chamber and includes a thermally-insulated housing, said heating chamber having disposed therein two rows of upper heating elements in an upper part of the heating chamber and two rows of lower heating elements in a lower part of the heating chamber, two end annular partitions disposed on edges of the heating chamber, a partition disposed along the lower part of the heating chamber, screening partitions in the upper part of the heating chamber for directing an exhaust gas stream from the upper heating elements upward in the heating chamber and restricting the influence of the lower heating elements on them, screening partitions in the lower part of the heating chamber for restricting lateral movement of an exhaust gas stream from the lower heating elements and mutual influence thereof, and a branch pipe for the removal of flue gases, which is situated in the upper part of the heating chamber;

a feed pipe for supplying an atmosphere of water vapor or carbon dioxide gas to the pyrolysis chamber;

a pipe for the removal of gaseous products from the pyrolysis chamber, wherein the two rows of upper heating elements and the two rows of lower heating elements are arranged along the length of the housing of the heating chamber symmetrically relative to a vertical plane that is an extension of an axis of the pyrolysis chamber;

the upper heating elements and the lower heating elements are in the form of units containing at least one flameless gas burner;

the upper heating elements are arranged in a checkerboard fashion relative to the lower heating elements; and the branch pipe for the removal of flue gases is provided with a heat exchanger, to which the feed pipe is connected for supplying an atmosphere of water vapor or carbon dioxide to the pyrolysis chamber.

8. The furnace according to claim 7, characterized in that the pyrolysis chamber is a rotary drum reactor.

9. The furnace according to claim 7, characterized in that the pyrolysis chamber is a screw reactor.

10. The furnace according to claim 7, characterized in that the screening partitions in the upper part of the heating chamber consist of two side parts made in the form of a ring segment and disposed on both sides of each upper heating element, the side parts being coupled by a splitter directed toward the lower heating elements.

11. The furnace according to claim 7, characterized in that the screening partitions in the lower part of the heating chamber are made in the form of a ring segment.

12. The furnace according to claim 7, characterized in that the heat exchanger is coil-shaped.

13. The furnace according to claim 7, characterized in that the pyrolysis chamber is provided with pressure and temperature sensors.

14. The furnace according to claim 7 wherein the upper part of the heating chamber abuts and is connected to the lower part of the heating chamber.

* * * * *